US007861376B2

(12) United States Patent
Fitz et al.

(10) Patent No.: US 7,861,376 B2
(45) Date of Patent: Jan. 4, 2011

(54) HINGE WITH DAMPER

(75) Inventors: Helmut Fitz, Lustenau (AT); Harald Sutterlütti, Fussach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/798,730

(22) Filed: May 16, 2007

(65) Prior Publication Data

US 2007/0251058 A1 Nov. 1, 2007

Related U.S. Application Data

(63) Continuation of application No. PCT/AT2005/000462, filed on Nov. 16, 2005.

(30) Foreign Application Priority Data

Nov. 22, 2004 (AT) ..... A 1952/2004
Mar. 8, 2005 (AT) ..... A 396/2005

(51) Int. Cl.
*E05F 1/08* (2006.01)

(52) U.S. Cl. ..... 16/286; 16/355

(58) Field of Classification Search ..... 16/286, 16/287, 355
See application file for complete search history.

(56) References Cited

U.S. PATENT DOCUMENTS

| | | | | | |
|---|---|---|---|---|---|
| 769,201 | A * | 9/1904 | Blarcom et al. | ..... | 16/68 |
| 1,700,086 | A * | 1/1929 | Sherwood | ..... | 16/85 |
| 2,674,761 | A * | 4/1954 | Weiss | ..... | 16/288 |
| 2,698,957 | A * | 1/1955 | Vigmostad | ..... | 16/302 |
| 2,698,959 | A * | 1/1955 | Vigmostad | ..... | 16/294 |
| 3,153,257 | A * | 10/1964 | Daenzer | ..... | 16/302 |
| 3,363,281 | A * | 1/1968 | Borsani | ..... | 16/288 |
| 3,863,292 | A * | 2/1975 | Grunert et al. | ..... | 16/236 |
| 3,975,791 | A * | 8/1976 | Hettich et al. | ..... | 16/294 |
| 4,075,735 | A * | 2/1978 | Rock et al. | ..... | 16/278 |
| 4,506,409 | A * | 3/1985 | Lautenschlager | ..... | 15/238 |
| 4,817,241 | A * | 4/1989 | Koch et al. | ..... | 16/238 |
| 4,841,598 | A * | 6/1989 | Grass | ..... | 16/251 |
| 5,058,238 | A * | 10/1991 | Lautenschlager | ..... | 16/278 |
| 5,392,493 | A * | 2/1995 | Youngdale | ..... | 16/237 |
| 5,437,079 | A | 8/1995 | Park | | |
| 5,957,383 | A * | 9/1999 | Benest | ..... | 239/166 |
| 6,243,918 | B1 * | 6/2001 | Zetti | ..... | 16/298 |
| 6,470,531 | B2 * | 10/2002 | Domenig et al. | ..... | 16/240 |
| 6,591,454 | B2 * | 7/2003 | Brustle | ..... | 16/374 |
| 6,618,904 | B1 * | 9/2003 | Nagy | ..... | 16/370 |

(Continued)

FOREIGN PATENT DOCUMENTS

| | | |
|---|---|---|
| DE | 91 07 000 | 10/1991 |

(Continued)

*Primary Examiner*—Victor Batson
*Assistant Examiner*—Roberta Delisle
(74) *Attorney, Agent, or Firm*—Wenderoth, Lind & Ponack, L.L.P.

(57) ABSTRACT

The invention relates to a hinge, particularly for movable furniture parts (1), comprising: at least seven rotational pins; at least two stop parts (2, 3) for fastening to furniture parts (1) or the like, and; a linear damping device for damping an opening and/or closing movement of the hinge. This hinge is designed in such a manner that all components (8, 9) of the linear damping device (7) execute a motion relative to both stop parts (2, 3) during the opening and/or closing movement of the hinge.

24 Claims, 8 Drawing Sheets

U.S. PATENT DOCUMENTS

| | | | | |
|---|---|---|---|---|
| 6,684,453 | B2 * | 2/2004 | Wang | 16/54 |
| 6,694,567 | B1 * | 2/2004 | Domenig et al. | 16/238 |
| 6,698,062 | B2 * | 3/2004 | Egger et al. | 16/242 |
| 7,065,833 | B2 * | 6/2006 | Kropf | 16/286 |
| 7,096,535 | B2 * | 8/2006 | Lin | 16/287 |
| 7,197,790 | B1 * | 4/2007 | Edmondson | 16/336 |
| 7,562,416 | B2 * | 7/2009 | Lautenschlager et al. | 16/286 |
| 2004/0205935 | A1 * | 10/2004 | Lautenschlaeger et al. | 16/374 |
| 2004/0226139 | A1 * | 11/2004 | Salice | 16/286 |
| 2005/0155180 | A1 * | 7/2005 | Lin | 16/287 |
| 2005/0177980 | A1 * | 8/2005 | Herper | 16/366 |

FOREIGN PATENT DOCUMENTS

| | | |
|---|---|---|
| DE | 202 00 762 | 5/2002 |
| DE | 20 2004 006 279 | 7/2004 |
| EP | 0 994 229 | 4/2000 |
| WO | 03/093616 | 11/2003 |
| WO | 2004/083580 | 9/2004 |

* cited by examiner

HINGE WITH DAMPER

This application is a continuation application of International Application PCT/AT2005/000462, filed Nov. 16, 2005.

BACKGROUND OF THE INVENTION

The present invention relates to a hinge, in particular for movable furniture parts. The hinge has at least seven rotatable axes and at least two fastening parts for securing the hinge to furniture parts or the like, and has a linear damper to dampen an opening and/or a closing movement of the hinge.

With the linear dampers used in the state of the art to dampen the movement of furniture parts, the maximum stroke is limited. On the other hand, though, it must still be possible to accomplish a certain minimum stroke, in order to achieve the desired smooth damping of the movement. The realization of these requirements is constantly restricted in practice by the hinge geometry. Consequently, it is often difficult to incorporate a linear damper into the hinge in such a way that, on the one hand, the damping starts to work at the desired angle and, on the other hand, there is also sufficient stroke available for the damping not to be too abrupt.

It is an object of the invention to further develop a generic hinge in such a way that these problems are at least largely eliminated.

SUMMARY OF THE INVENTION

This is accomplished according to the invention by designing the hinge in such a way that all components of the linear damper perform a relative movement to both fastening parts during the opening and/or closing movement of the hinge.

A basic idea of the invention is therefore to attach a linear damper to at least one fastening part of the hinge in such a way that the linear damper moves relative to both the furniture body and also relative to the furniture doors once the hinge has been assembled. In this way, both the stroke of the linear damper and the moment or opening angle, respectively, at which the linear damper starts to operate are relatively freely set through the choice of geometry for the individual hinge parts. It is favorably provided in this case that the linear damper is, preferably exclusively, supported by or mounted onto intermediate pieces and/or articulated levers that are movable relative to the fastening parts.

BREIF DESCRIPTION OF THE DRAWINGS

Further features and details of the present invention emerge from the following description of the figures. In the figures.

DETAILED DESCRIPTION OF THE INVENTION

Figure 11:
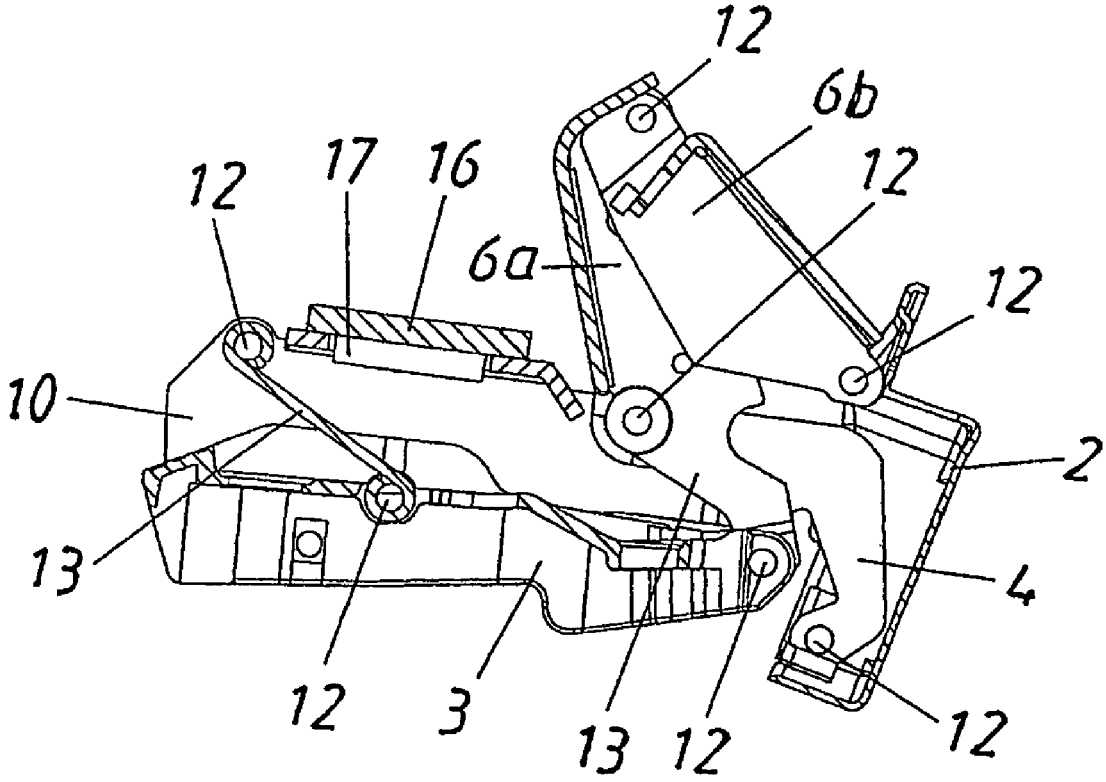

All three embodiments show so-called wide-angle hinges, in which it is particularly favorable for the linear damper to be arranged according to the invention. All hinges have at least seven rotatable axes (pins) 12, which can be seen in FIGS. 2, 5 and 11, for instance. The axes 12 in the hinge pot 2, which are actually concealed where necessary in these illustrations, are depicted using a dotted line. In all variants shown here, so-called linear dampers are used. When it comes to choosing a linear damper, there is a wide range of different state-of-the-art models available.

The hinges shown have—as known per se—a hinge arm 3 and a hinge pot 2. These two fastening parts are each secured to or in different furniture parts. The hinge arm 3 is secured on a base plate fixed to the furniture part 1 in a clip-on manner and therefore indirectly fastened to the furniture part. However, the hinge arm 3 can also be fixed directly to the furniture part 1. The two fastening parts 2 and 3 are connected to one another via two articulated levers 4 and 5, wherein the first articulated lever 4 is fixed here in one piece to an intermediate piece 10 and the second articulated lever 5 has two limbs **6*a* and 6*b*** that can be tilted with respect to one another.

A component of the linear damper 7, in this case the cylinder 8, is disposed on the intermediate piece 10. In the first two exemplary embodiments according to FIGS. 1 to 6, the ram (piston rod) 9 that can be displaced relative to the cylinder 8 is acted upon via the articulated lever 5. In the first exemplary embodiment in accordance with FIGS. 1-3 it only abuts the articulated lever 5 for this purpose (i.e., the ram 9 is not connected to lever 5). In the second embodiment according to FIGS. 4-6, the ram (piston rod) 9 is permanently connected to the articulated lever 5 via a ram joint 15. In the third embodiment in accordance with FIGS. 7-11, the ram (piston rod) 9 is supported either by a fastening part, in this case the hinge pot 2, or by a furniture part 1 that can be connected to the fastening part. The ram 9 and cylinder 8 may even be the corresponding components of a linear damper, but also simply form the housing components in which a corresponding linear damper known in the state of the art is included.

Figure 1:
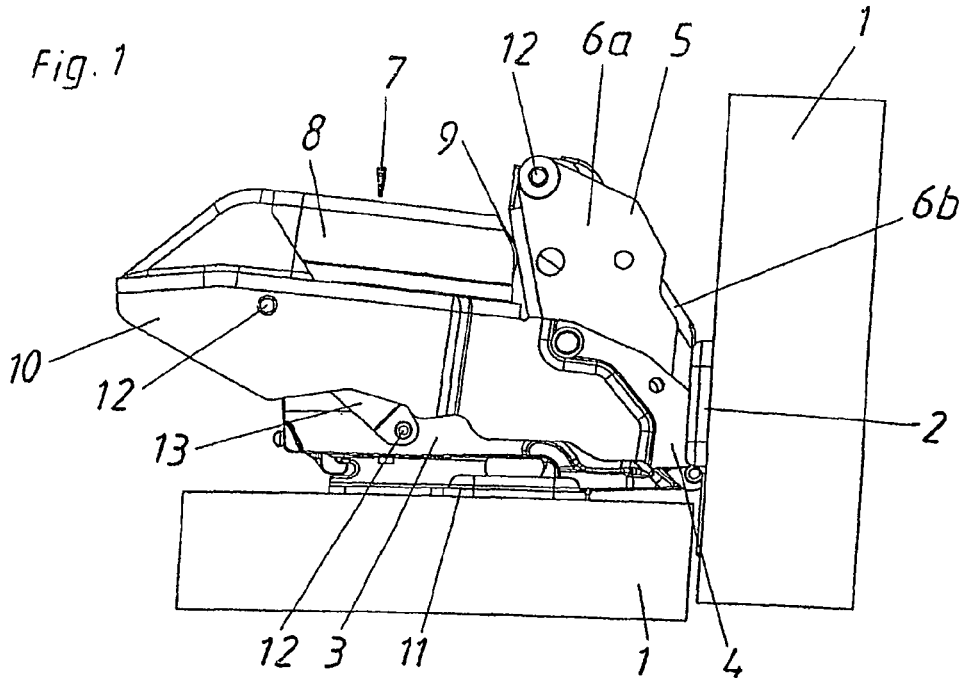
FIGS. 1-3 show a first exemplary embodiment of the invention.
Figure 2:
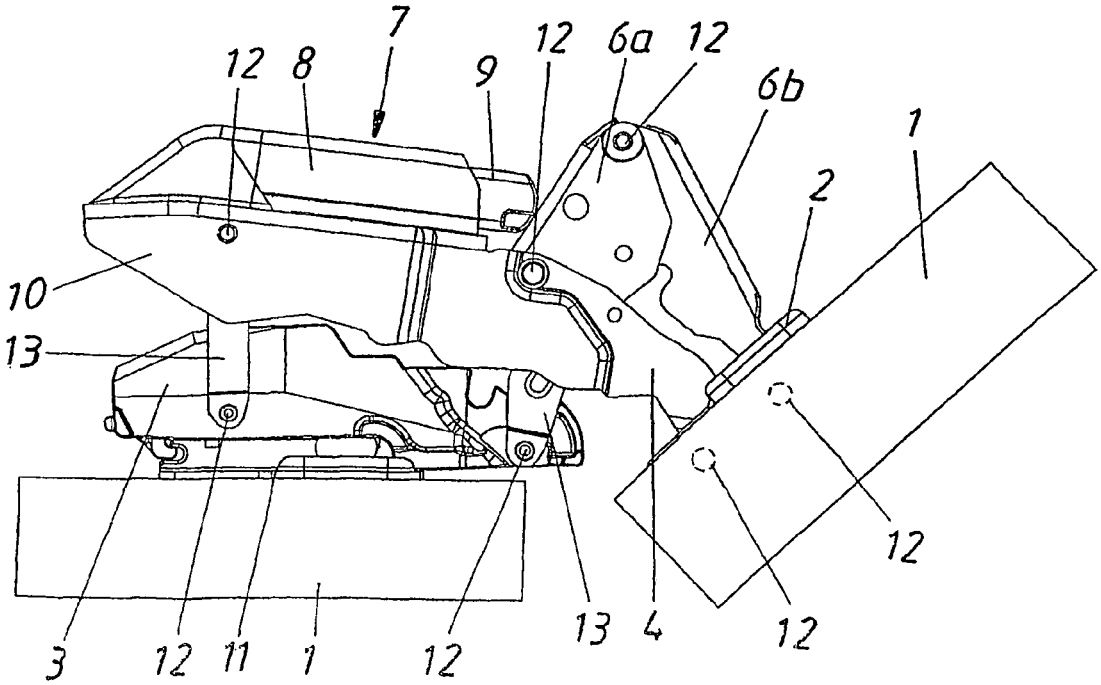
Figure 3:
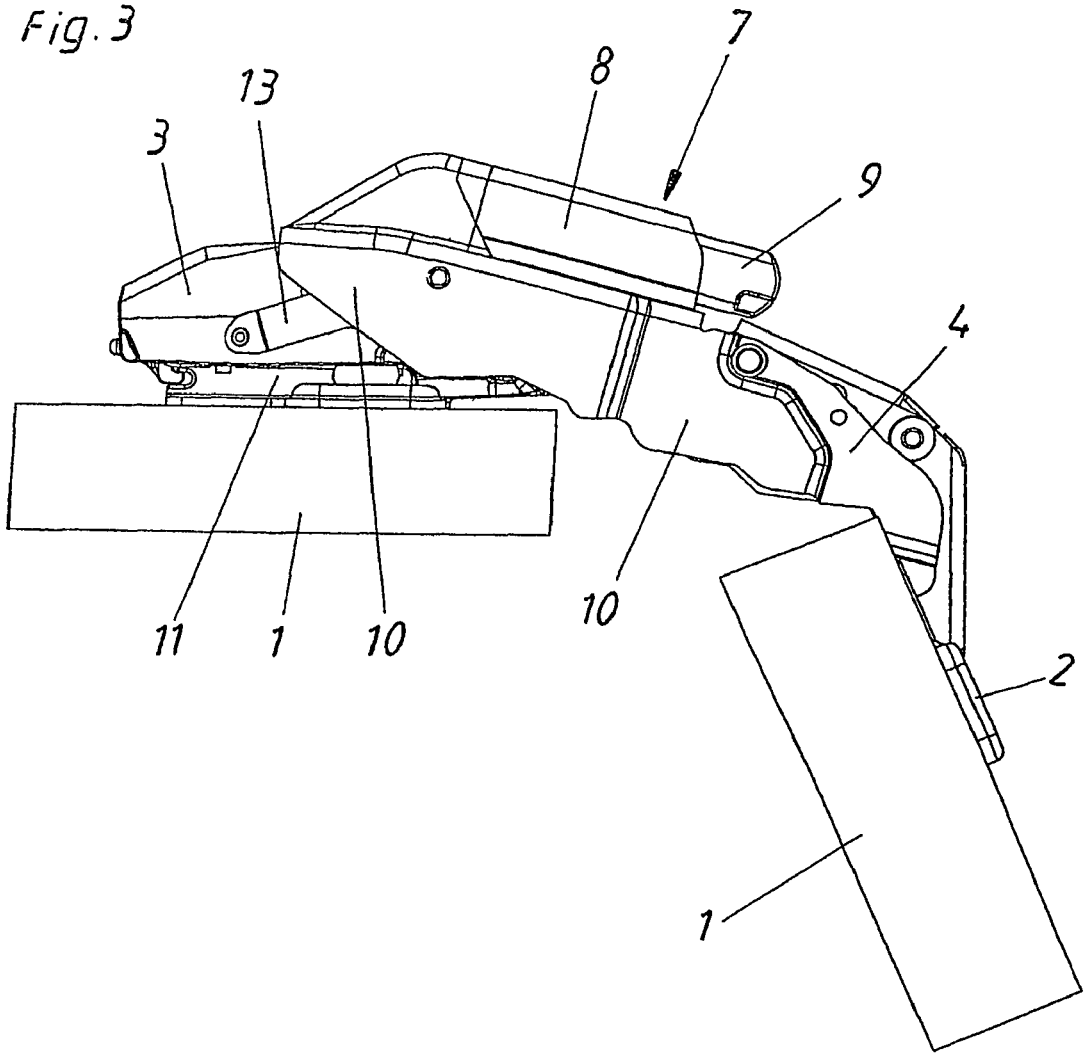
Figure 4:
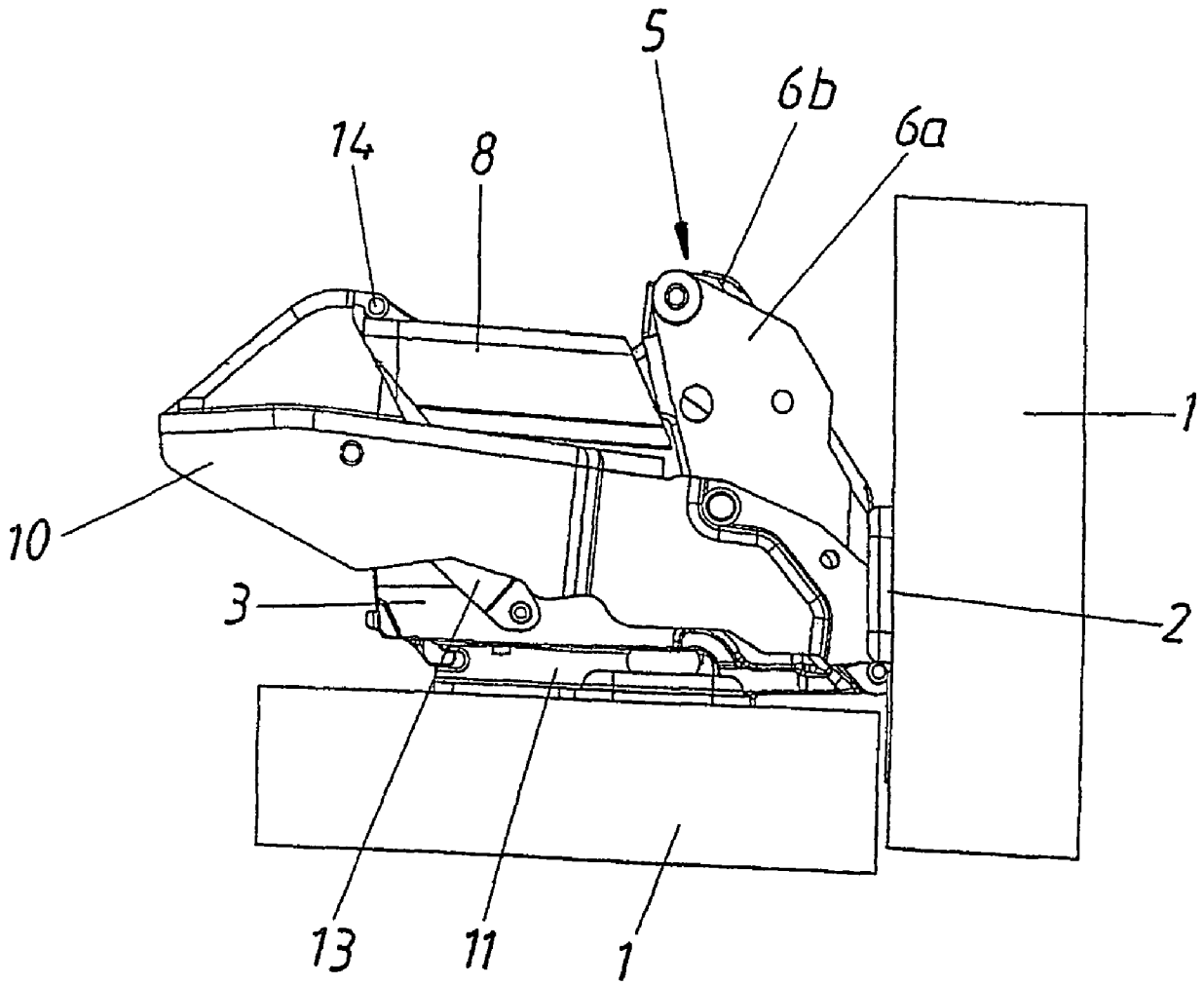
FIGS. 4-6 show a second embodiment according to the invention.
Figure 5:
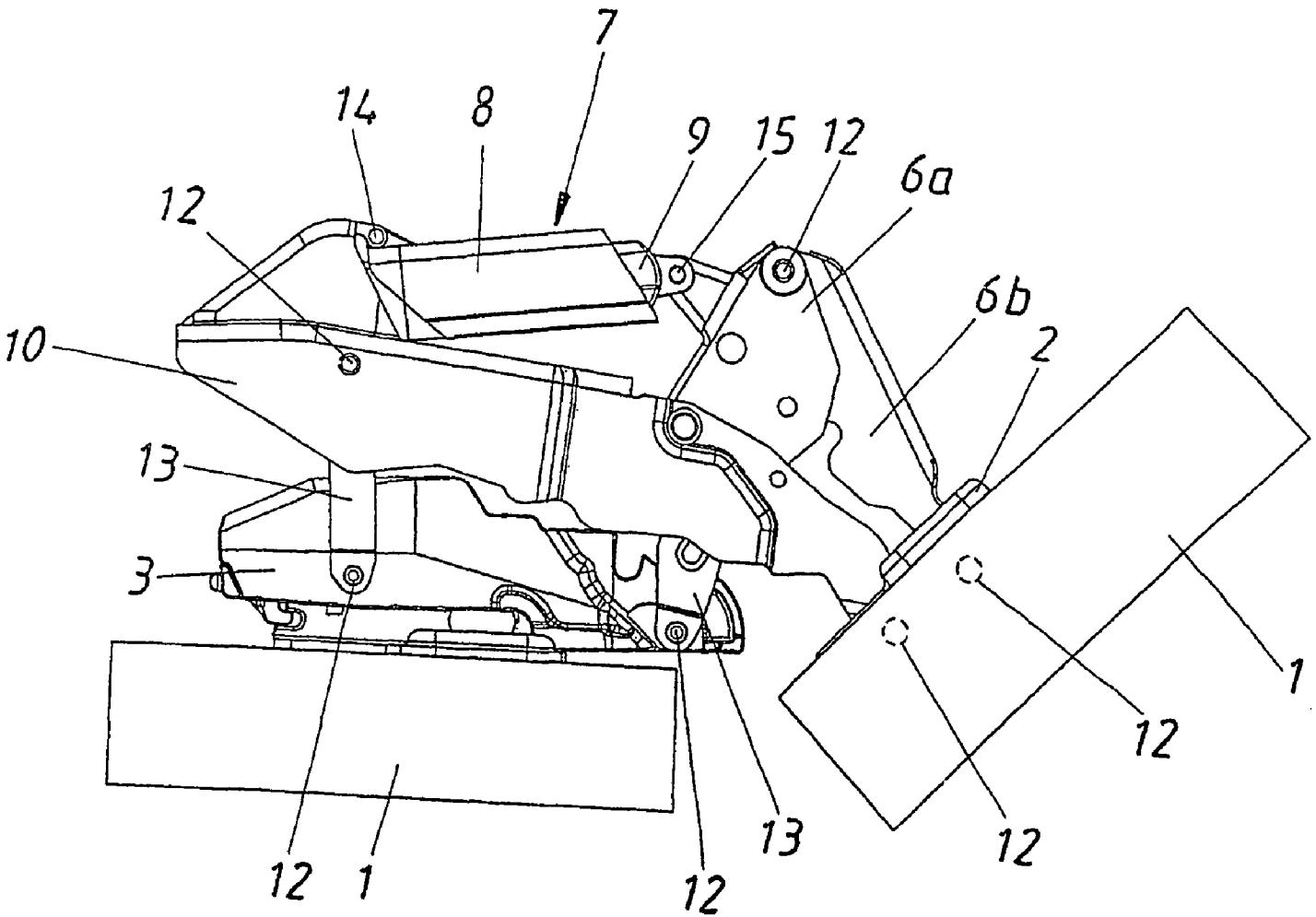
Figure 6:
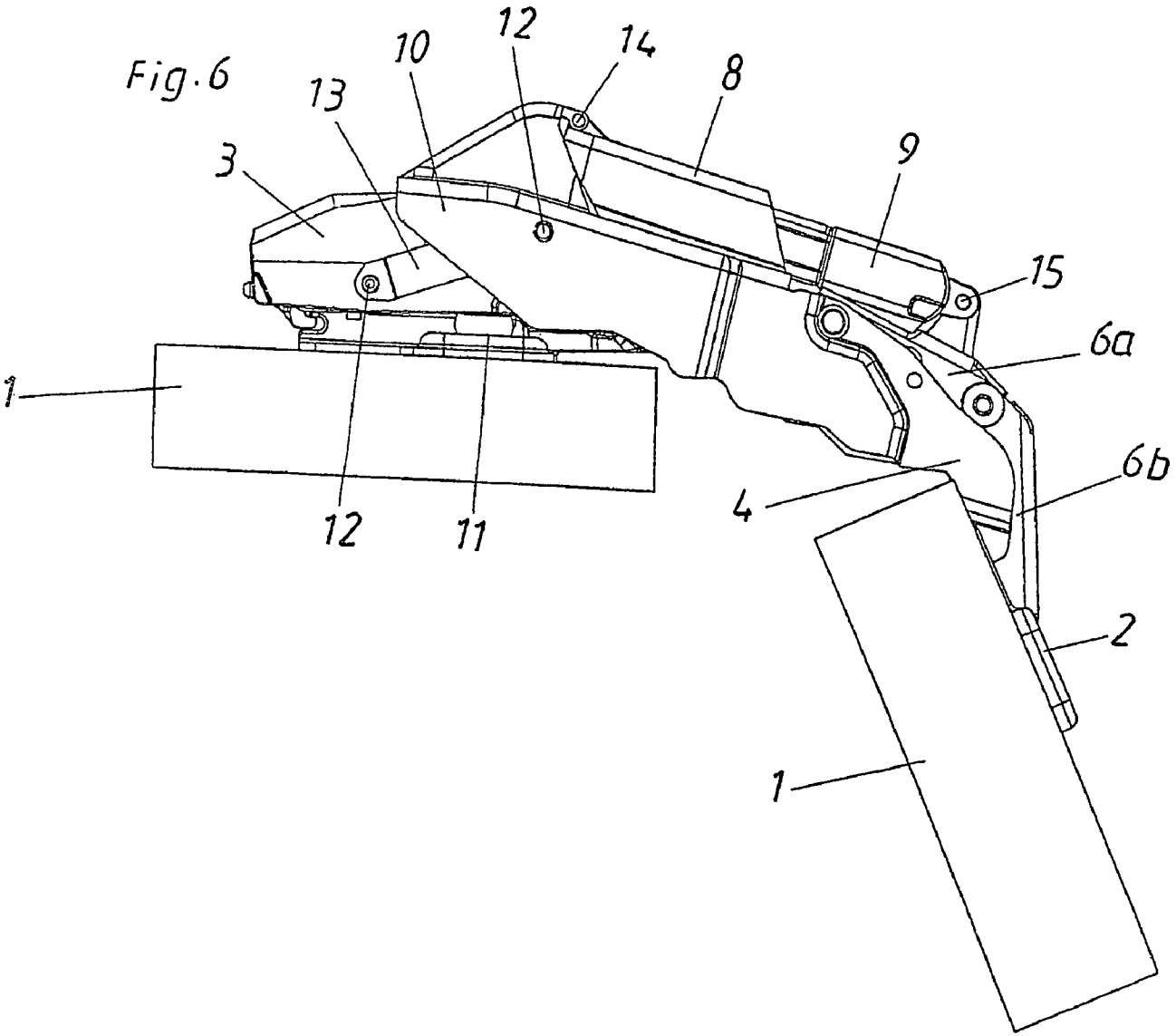
Figure 7:
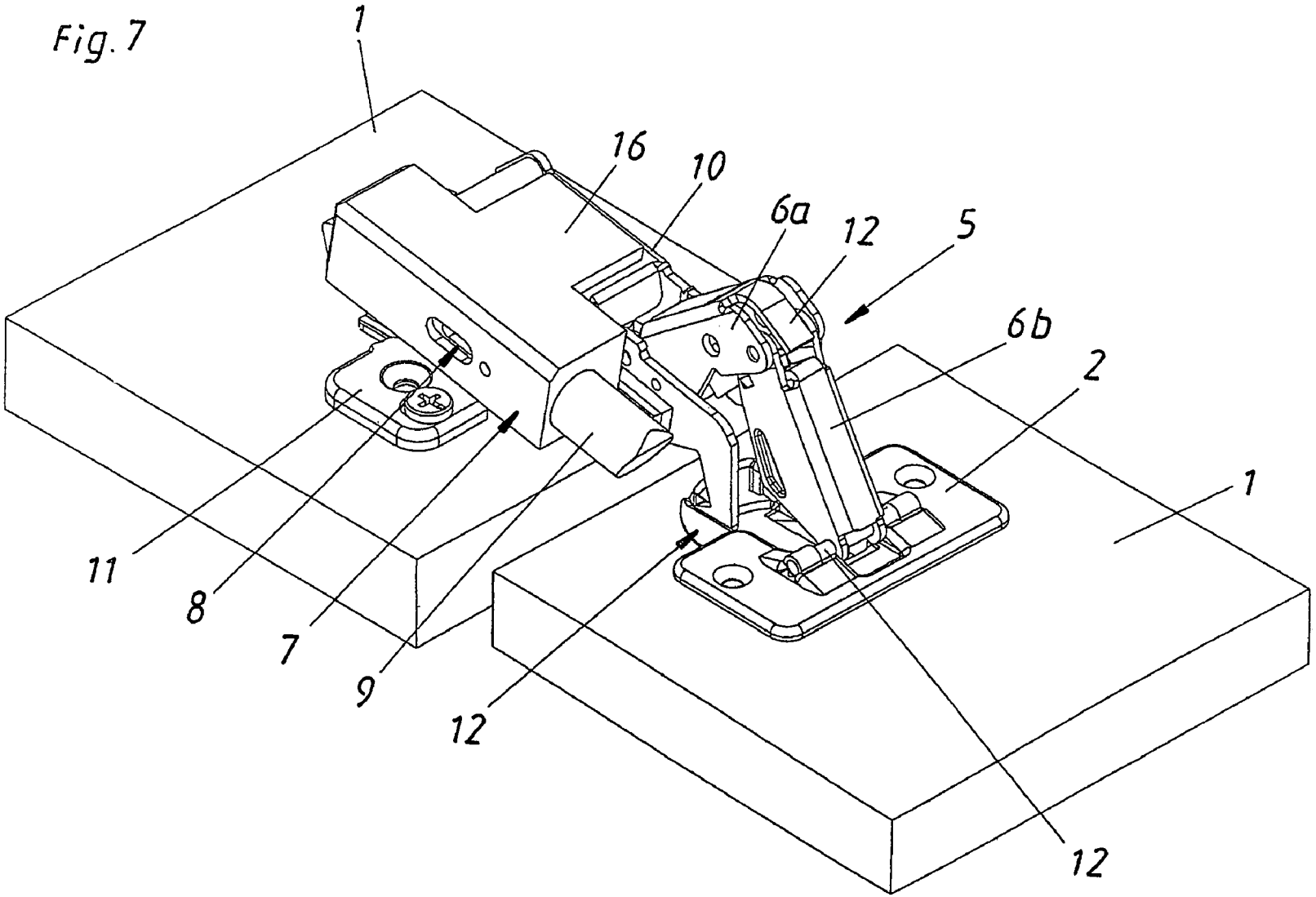
FIGS. 7-11 show a third embodiment according to the invention.
Figure 8:
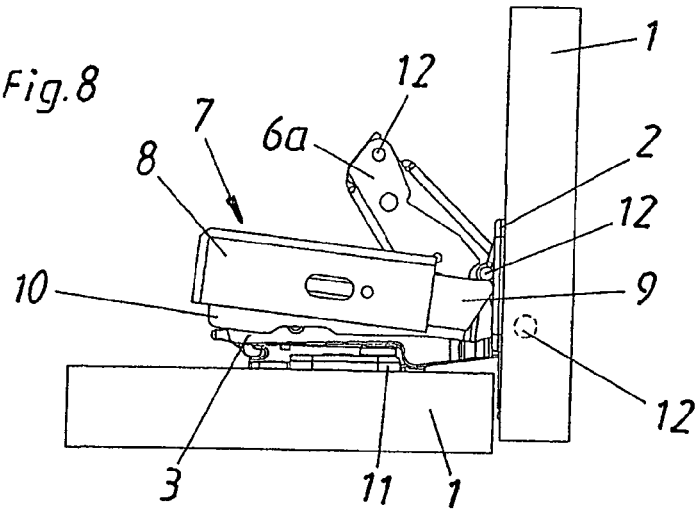
Figure 9:
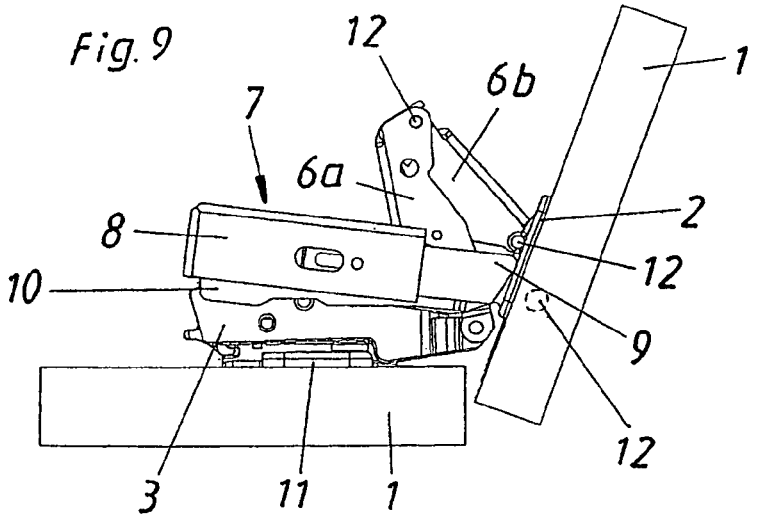
Figure 10:
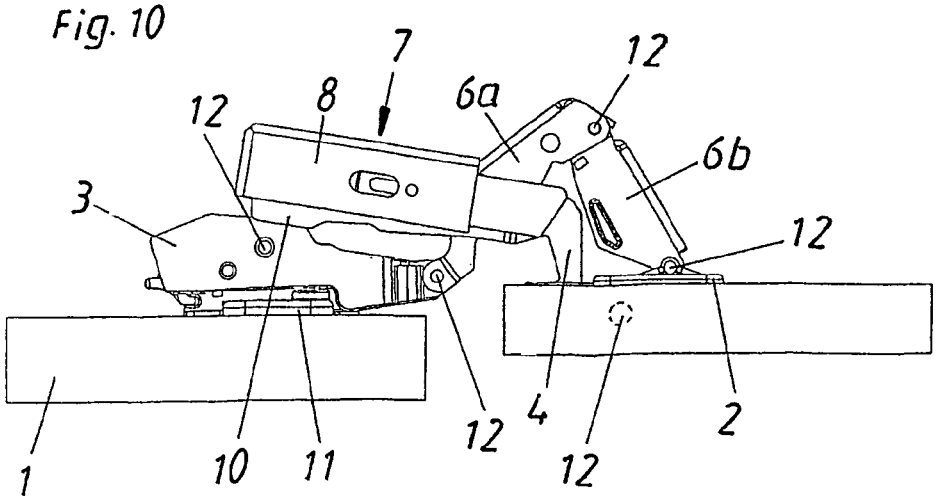

The intermediate piece 10 is forcibly coupled to a fastening part—in this case the lever arm 3—via two connecting levers 13, wherein the connecting levers 13 are swivel-mounted both on the intermediate piece 10 and also on the fastening part (hinge arm 3) via corresponding axes 12. The intermediate piece 10 has an essentially U-shaped profile in all exemplary embodiments, enabling the corresponding fastening part—thus in this case the hinge arm 3—to be at least partly encompassed by the intermediate piece 10. The connecting lever 13 disposed closest to the hinge pot is integrated into the first limb **6*a* of the articulated lever 5 in all exemplary embodiments. However, this need not necessarily be the case. The function of the intermediate piece 10 and also the connecting lever 13 becomes clear when comparing FIGS. 1 to 3 and 4 to 6 and 8 to 10 with one another. FIGS. 1, 4 and 8 each show a first end position of the hinge, in which the latter is in the closed position. FIGS. 3, 6 and 10 show the open position in each case, while the hinge in FIGS. 2, 5 and 9 is shown in an intermediate position in each case. By means of the intermediate piece 10, it is possible not only to pivot the two furniture parts 1 relative to one another, but also to increase their distance from one another while pivoting. To achieve this, the intermediate piece 10 is tilted away by means of the connecting lever 13 from the first end (closed) position shown in FIGS. 1, 4 and 8 via the hinge arm 3, and extends the connecting lever 13 in the end position depicted in FIGS. 3, 6 and 10. This enables the two fastening parts 2 and 3 to be at varying distances from one another in the two end positions. The cylinder 8 of the linear damper 7 anchored on the intermediate piece 10 is moved along with the intermediate piece 10. The linear damper 7 may be fixed on the intermediate piece 10, as in the first exemplary embodiment, but also pivotably secured to the intermediate piece 10 via a joint 14**, as in the second exemplary embodiment.

In the third exemplary embodiment, the linear damper 7, (in this case with its cylinder 8,) is detachably secured, (in this case by clip-on means), to the intermediate piece 10. A mounting plate 16, which in turn has a latching element 17, is disposed on the linear damper 7. The latching element 17 can snap into a corresponding recess in the intermediate piece 10 and is then detachably secured to it. Equally good, however, is a solution whereby the linear damper 7, preferably once again via its cylinder 8, can be detachably secured to or mounted on one of the articulated levers 4, 5. In the third exemplary embodiment according to FIGS. 7-11, the linear damper 7 and its cylinder 8, in plan view, is disposed on one of the fastening parts 2, 3 to the side of the center of the fastening part, thus in this case essentially alongside a fastening part designed as a hinge arm 3. It can be seen from the sectional representation in FIG. 11 that with this embodiment the rear lever 13 is disposed within the hinge arm 3 and within the intermediate piece 10, while in the first two embodiments according to FIGS. 1-6 it is disposed outside on the hinge arm 3.

Overall according to the invention, all components 8, 9 of the linear damper 7 perform a relative movement to both fastening parts 2 and 3 during the opening and/or closing movement. As a result, both the desired stroke and also the initial position at which the damping starts are very freely settable through a corresponding choice of geometry.

The invention claimed is:

1. A hinge for movable furniture parts, comprising:

a first fastening part and a second fastening part to be respectively secured to the furniture parts;

at least seven rotatable axes arranged to allow relative movement between said first fastening part and said second fastening part;

an abutment member; and a linear damper for damping the relative movement between said first fastening part and said second fastening part in a closing direction, said linear damper including a base portion and a ram having a base end movably mounted to said base portion such that said ram is configured to move linearly with respect to said base portion, said ram further having a free end opposite said base end for contacting said abutment member, said ram being configured such that said free end is spaced apart from said abutment member when said hinge is in an open position, and such that said free end contacts said abutment member when said hinge is in a closed position;

wherein said first fastening part, said second fastening part, said at least seven rotatable axes, said abutment member, and said linear damper are arranged such that an entirety of said linear damper moves relative to both said first fastening part and said second fastening part during the relative movement between said first fastening part and said second fastening part in said closing direction, and such that said free end of said ram contacts said abutment member during only a part of an entire range of the relative movement between said first fastening part and said second fastening part so that said linear damper thereby applies a force between said first fastening part and said second fastening part only during said part of the entire range of the relative movement between said first fastening part and said second fastening part, said part of the entire range of the relative movement being less than the entire range of the relative movement.

2. The hinge of claim 1, wherein said hinge is a wide-angle hinge.

3. The hinge of claim 1, further comprising intermediate pieces and articulated levers arranged to be movable relative to said first fastening part and said second fastening part and to link said first fastening part to said second fastening part, said linear damper being supported by at least one of a group consisting of said intermediate pieces and said articulated levers.

4. The hinge of claim 3, wherein said linear damper is supported by only said at least one of a group consisting of said intermediate pieces and said articulated levers.

5. The hinge of claim 3, wherein said ram is arranged to be acted upon by at least one of said articulated levers, said at least one of said articulated levers comprising said abutment member.

6. The hinge of claim 5, wherein said base portion of said linear damper comprises a ram joint pivotally mounting said ram to said at least one of said articulated levers.

7. The hinge of claim 6, wherein each of said articulated levers to which said ram of said linear damper is mounted comprises at least two limbs shaped and arranged to be tilted with respect to one another.

8. The hinge of claim 3, wherein said linear damper is detachably mounted to said at least one of a group consisting of said intermediate pieces and said articulated levers.

9. The hinge of claim 8, further comprising a clip-on member for detachably mounting said linear damper to said at least one of a group consisting of said intermediate pieces and said articulated levers.

10. The hinge of claim 1, wherein said free end of said ram is arranged to be acted upon by said abutment member comprised of at least one of a group consisting of said first fastening part, said second fastening part, and one of the furniture parts.

11. The hinge of claim 10, wherein said free end of said ram is arranged to be acted upon by said abutment member comprised of said first fastening part, said first fastening part comprising a hinge pot.

12. The hinge of claim 1, further comprising at least two levers and an intermediate piece coupled to one of said first fastening part and said second fastening part via said at least two levers, said linear damper being mounted to said intermediate piece, said at least two levers being pivotally mounted to said intermediate piece and pivotally mounted to said one of said first fastening part and said second fastening part.

13. The hinge of claim 12, wherein said linear damper is pivotally mounted to said intermediate piece.

14. The hinge of claim 12, wherein said base portion of said linear damper comprises a cylinder, said cylinder being pivotally mounted to said intermediate piece.

15. The hinge of claim 12, wherein said one of said first fastening part and said second fastening part is a hinge arm to be fixed to one of the furniture parts either directly or via a base plate.

16. The hinge of claim 15, wherein said intermediate piece has a U-shaped profile, said hinge arm being at least partly encompassed by said intermediate piece.

17. The hinge of claim 12, wherein said intermediate piece is operable to adopt a first end position and a second end position relative to said one of said first fastening part and said second fastening part, said first fastening part and said second fastening part being further apart from each other in the first end position than in the second end position.

18. The hinge of claim 1, wherein said linear damper is mounted to one of said first fastening part and said second fastening part so as to be located at a side of a center axis of said one of said first fastening part and said second fastening part.

19. The hinge of claim 18, wherein said one of said first fastening part and said second fastening part comprises a hinge arm, said linear damper being mounted alongside said hinge arm.

20. The hinge of claim 18, wherein said base portion of said linear damper comprises a cylinder, said cylinder being mounted to said one of said first fastening part and said second fastening part.

21. The hinge of claim 1, wherein each of said at least seven rotatable axes comprises a pin.

22. A hinge for movable furniture parts, comprising:

a first fastening part and a second fastening part to be respectively secured to the furniture parts;

at least seven rotatable axes arranged to allow relative movement between said first fastening part and said second fastening part; and a linear damper for damping the relative movement between said first fastening part and said second fastening part in a closing direction;

wherein said first fastening part, said second fastening part, said at least seven rotatable axes, and said linear damper are arranged such that an entirety of said linear damper moves relative to both said first fastening part and said second fastening part during the relative movement between said first fastening part and said second fastening part in said closing direction, and such that said linear damper applies a damping force between said first fastening part and said second fastening part during only a part of an entire range of the relative movement between said first fastening part and said second fastening part in the closing direction, said part of the entire range of the relative movement being less than the entire range of the relative movement.

23. The hinge of claim 22, further comprising an abutment member, wherein said linear damper includes a base portion and a ram having a base end movably mounted to said base portion such that said ram is configured to move linearly with respect to said base portion, said ram further having a free end opposite said base end for contacting said abutment member, said ram being configured such that said free end is spaced apart from said abutment member when said hinge is in an open position, and such that said free end contacts said abutment member when said hinge is in a closed position.

24. A hinge for movable furniture parts, comprising:

a first fastening part and a second fastening part to be respectively secured to the furniture parts;

a plurality of rotatable axes arranged to allow relative movement between said first fastening part and said second fastening part;

an abutment member; and a linear damper for damping the relative movement between said first fastening part and said second fastening part in a closing direction, said linear damper including a base portion and a ram having a base end movably mounted to said base portion such that said ram is configured to move linearly with respect to said base portion, said ram further having a free end opposite said base end for contacting said abutment member, said ram being configured such that said free end is spaced apart from said abutment member when said hinge is in an open position, and such that said free end contacts said abutment member when said hinge is in a closed position;

wherein said first fastening part, said second fastening part, said rotatable axes, said abutment member, and said linear damper are arranged such that an entirety of said linear damper moves relative to both said first fastening part and said second fastening part during the relative movement between said first fastening part and said second fastening part in said closing direction, and such that said free end of said ram contacts said abutment member during only a part of an entire range of the relative movement between said first fastening part and said second fastening part so that said linear damper thereby applies a force between said first fastening part and said second fastening part only during said part of the entire range of the relative movement between said first fastening part and said second fastening part, said part of the entire range of the relative movement being less than the entire range of the relative movement.

* * * * *